United States Patent [19]

Mendenhall

[11] Patent Number: 5,032,448

[45] Date of Patent: Jul. 16, 1991

[54] MULTI-LAYERED PACKAGING MATERIAL AND METHOD

[75] Inventor: Abraham H. Mendenhall, Morris County, N.J.

[73] Assignee: Packaging Concepts Inc., St. Louis, Mo.

[21] Appl. No.: 235,463

[22] Filed: Aug. 24, 1988

[51] Int. Cl.[5] ..... B32B 7/14

[52] U.S. Cl. ..... 428/189; 219/10.55 E; 383/113; 383/116; 426/107; 428/191; 428/201; 428/220

[58] Field of Search ..... 428/34.3, 35.4, 35.5, 428/35.8, 35.9, 77, 189, 191, 201, 220; 219/10.55 E; 383/113, 116; 426/107

[56] References Cited

U.S. PATENT DOCUMENTS

| | | | |
|---|---|---|---|
| 4,496,815 | 1/1985 | Jorgensen | 219/10.55 E |
| 4,518,651 | 5/1985 | Wolfe | 428/319.7 |
| 4,661,671 | 4/1987 | Maroszek | 219/10.55 E |
| 4,698,472 | 10/1987 | Cox | 219/10.55 E |
| 4,861,958 | 8/1989 | Bohrer | 219/10.55 E |
| 4,878,765 | 11/1989 | Watkins | 428/34.3 |

*Primary Examiner*—Jenna Davis
*Attorney, Agent, or Firm*—Paul M. Denk

[57] ABSTRACT

A multi-layered packaging material and method of making same, for use in wrapping, packaging and shipping articles, is disclosed. The multi-layered packaging material includes a flexible layer of food grade paper material having a predetermined width, a strip layer of microwave coupling material which becomes hot in a microwave oven when exposed to microwave energy and having a substantially smaller width than the flexible layer, and a masking layer of food grade paper material having a dimensional size only slightly larger than the strip layer. The layers are adhesively bonded and laminated together with the overlapping edges of the strip layer being adhesively bonded to the flexible layer.

2 Claims, 2 Drawing Sheets

MULTI-LAYERED PACKAGING MATERIAL AND METHOD

BACKGROUND OF THE INVENTION

The present invention relates to a multi-layered packaging material for use in wrapping, packaging and shipping articles, and also to a method of forming the multi-layered packaging material.

Packaging materials, used for pre-formed bags and other containers, especially those used for microwave popcorn, have produced new and unforeseen problems as the result of the need to use specific types of packaging materials. Pre-formed microwave popcorn bags typically use packaging materials that include two plys of specially treated paper, with a metallized film or patch interposed therebetween. Because heat assisted metallized films or patches are used in such packaging materials, the paper plys are typically flourocarbon treated paper plys, in order to keep the metallized film or patch from contact with food, while serving as an insulator between the hot surface of the metallized film or patch and the food. In addition, the paper flourocarbon plys are treated also for grease stain resistance, quite obviously to prevent food grease from being transferred through the paper plys.

At the present time, there are two basic types of metallized film strips used for heat assist purposes in microwave packages. One type is a strip of metallized polyester film which has been de-metallized to allow the remaining metallized areas to be in the exact position required to achieve heating of food in the package. The second type is a patch of a metallized film which is die cut and placed in the package by a special machine attachment incorporated in the forming or laminating line.

The new and unforeseen problems that have been encountered, as the result of using packaging materials as described above, relate to the type and amount of adhesive used to laminate the paper plys and metallized film ply or patch to each other, to form the multi-layered packaging material. Adhesives used to laminate the aforementioned plys to one another are FDA approved, water based adhesives that are readily usable in forming or laminating lines.

Unfortunately, these water based adhesives "trap-in" the moisture between the various plys in the packaging material, and this causes slow absorption into the paper plys, with moisture retention even occurring after the food is in a pre-formed bag. The problem is made worse by the use of flourocarbon and grease stain treated papers. As will be appreciated, such papers do not readily permit any wicking action because they are treated to do just the opposite, i.e., to eliminate greasy food stains on the outside of the pre-formed bags. The result is that the paper plys greatly reduce the normal drying action of the water based adhesives and moisture which are trapped inside of the package, making it difficult for rapid wicking of the paper plys. Where moisture from the water based adhesives is trapped inside the paper plys, the pre-formed bag becomes "wet" making it difficult to process, and in some cases, making the food appear less than desirable to eat.

In addition, odor from the adhesive remains within the package due to the lack of drying of the adhesive moisture. All adhesives have odors, even though the adhesive industry has greatly reduced the offensiveness of adhesive odors. Yet, it is still impossible to make an odor free adhesive.

Drying ovens and other equipment can be utilized to assist in the drying process, but this slows the production process, and further the ovens are not completely effective in removing "trapped-in" moisture. The relative large amounts of adhesive that are used also have the potential of possible food contamination, as the result of high temperatures created by the heat assisted metallized strip or patch. Various manufacturing conditions, storage and distribution time, and weather conditions cause the "trapped-in" moisture problem to exist in varying degrees at different times. However, the problem exists in one form or another, varying only in the level or degree of "wetness".

Over the years, various solutions have been proposed, most of which have helped to some degree, including the use of higher oven heat, lower odor adhesive, etc., but none have completely eliminated the odor or "wetness" problem under all types of production, weather, storage and distribution conditions.

SUMMARY OF THE INVENTION

Accordingly, among the several objects and advantages of the present invention may be noted;

The provision of new and improved multi-layer packaging material and method of forming same which overcomes the aforenoted deficiencies of the prior art;

The provision of the aforementioned multi-layered packaging material and method which eliminates the problem of retained moisture and attendant odors during the manufacturing of the multi-layered packaging material, and during subsequent use thereof in wrapping, packaging, and shipping articles;

The provision of the aforementioned multi-layered packaging material and method which is constructed to substantially reduce the amount of adhesive required for lamination and further includes an added feature of significantly improving drying of the adhesives that are used in bonding and laminating layers of the multi-layered packaging material together;

The provision of the aforementioned multi-layered packaging material and method which incorporates, in the construction of the multi-layered packaging material and the production method, the ability to allow moisture to readily escape from between the plys or layers of the packaging material, without relying on normal wicking through the paper plys or layers;

The provision of the aforementioned multi-layered packaging material and method which further has the added benefit of cost reduction through reduction of materials used, both with respect to layers or plys, and the amount of adhesive used;

The provision of the aforementioned multi-layered packaging material and method which provides improved production speeds in forming the multi-layered packaging material, with lower waste or product loss; and The provision of the aforementioned multi-layered packaging material and method which accomplishes all of the above objects and advantages, while keeping in-tact all of the other functions and purposes of the multi-layered packaging material and method.

Briefly stated, the multi-layered packaging material of the present invention is used in wrapping, packaging and shipping articles. The multi-layered packaging material includes a flexible layer of food grade paper material having a predetermined width which is capable of being folded into bag form and sealed to itself to form a bag structure having sides and a bottom. An intermediate strip layer of microwave coupling material which becomes hot in a microwave oven, when exposed to microwave energy is also provided, with the strip layer having a substantially smaller width than the flexible layer so as to be contained within one of the bag size and/or bag bottom. A masking layer of food grade paper material having a dimensional size only slightly larger than the strip layer is further provided. The masking layer provides overlapping edges which are adhesively bonded to the flexible layer to provide the multi-layered packaging material.

The width of the flexible layer is about 19"-20", the width of the strip layer of microwave coupling material being about 5"-6" and the masking layer being about only 1/16"-⅛" wider than the strip layer of microwave coupling material.

All of the layers are adhesively bonded to one another with the overlapping edges of the masking layer being adhesively bonded to the flexible layer. The food grade paper material may preferably be a grease proof paper sheet, with adhesive employed comprising a polyvinyl acetate. The strip layer of microwave coupling material may be a continuous strip of metallized polyester material, spaced patches of metallized film or areas on a strip, or may comprise a patch of metallized film which is die cut and positioned in the packaging material for the desired heat assist required.

The method of forming the multi-layered packaging material includes the forming of the bottom flexible layer of food grade paper material, forming an intermediate strip layer of microwave coupling material, and forming an upper masking layer of food grade paper material, all of which are constructed as described above. The aforementioned layers are adhesively bonded and laminated to one another with the overlapping edges of the masking layer being adhesively bonded to the flexible layer.

Other and further objects and advantages of the present invention will become more apparent from the ensuing description.

BRIEF DESCRIPTION OF THE DRAWINGS

In the drawings.

Corresponding reference numerals will be used throughout the various figures of the drawings.

DESCRIPTION OF THE PREFERRED EMBODIMENTS

Figure 1:
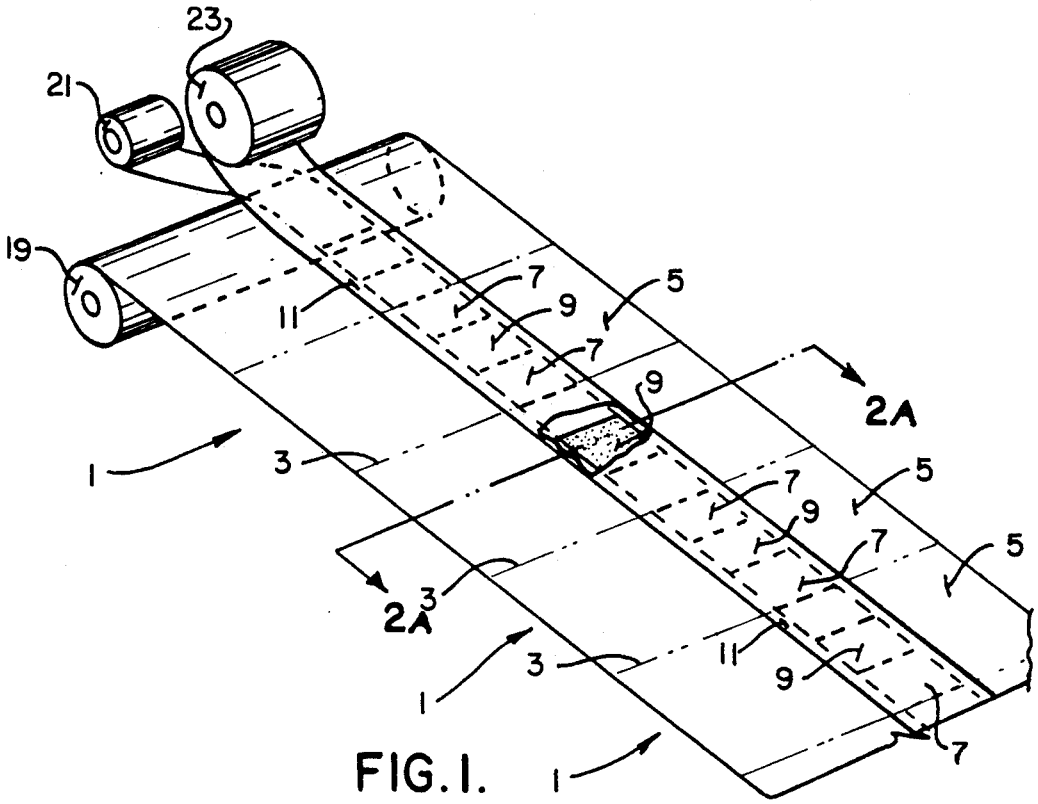
FIG. 1 is a fragmentary isometric view illustrating the multi-layered packaging material method of the present invention.

Referring now to the drawings, one embodiment of the multi-layered packaging material and the method used for forming the material is illustrated in FIGS. 1–4 of the drawings.

As shown in FIG. 1, a series of laminated packages or blanks 1 are shown as being separated from one another by the dotted lines 3 representing perforated areas, or the area along which subsequent die cutting will take place.

Figure 2B:
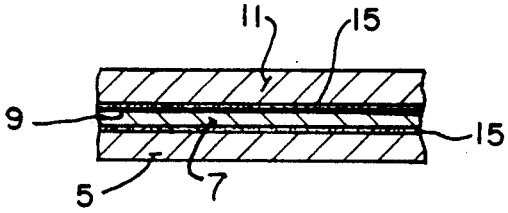
FIG. 2B is an enlarged fragmentary vertical sectional view as seen along line 2B—2B of FIG. 2A.
Figure 2A:
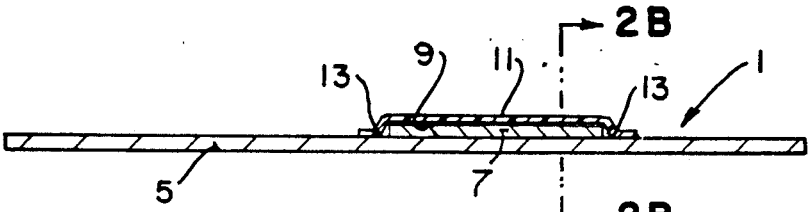
FIG. 2A is a vertical sectional view as viewed along lines 2A—2A of FIG. 1 and illustrating the construction of the multi-layered packaging material of the present invention.

As best seen in FIG. 2A of the drawing, each of the laminated packages or blanks 1 include a bottom flexible layer of food grade paper material 5 having a predetermined width, preferably on the order of approximately 19"-20". A food grade paper material from which the flexible bottom layer 5 is made is preferably a flourocarbon and grease proof treated sheet, so as to eliminate or minimize transfer of food grease through the paper layer or ply 5. One example of such material is manufactured as Rhineland Grade Lard-Pack S1B Grade 2343001 material.

Superimposed above the bottom flexible layer 5 and serving as the intermediate layer or ply of the laminate package or blank 1 is an intermediate strip layer 7 of microwave coupling material which becomes hot in a microwave oven when exposed to microwave energy. The intermediate strip layer 7 may include a polyester film having a thin coating of microwave coupling heat-absorbing material coated thereon so as to become hot when heated in a microwave oven. The coating can comprise any of the well-known microwave coupling materials such as semiconductive metal coatings, ferrites, certain metal oxides such as iron oxide, and magnetite in powdered form, or coatings of the type described in U.S. Pat. Nos. 4,267,420 and 4,230,924. The metallic coating is preferably applied by vacuum electrode deposition, and is semiconductive. The amount of metal applied during the electro deposition process will control the heating characteristics of the intermediate strip layer 7 microwave coupling material.

In lieu of a metallized polyester film as described above, a strip containing a series of spaced metallized patches may be provided or a patch of metallized film (not shown) may be die cut and placed within the laminated package or blank by special machine attachment in the forming or laminating line, as will be understood.

As best seen in FIG. 1 of the drawings, the intermediate strip layer 7 extends the full length of each laminated package or blank 1, and includes a centrally positioned microwave coupling material portion 9 that is centrally located relative to front and trailing edges of each laminated package or blank 1, as shown in FIG. 1 of the drawings. The location of the microwave coupling material portion 9 in the strip layer 7 also approximates the location of a metallized heat assist patch, not specifically shown, but certainly understood to include the die cut and patch placed at the same location in the laminated package or blank 1 as the microwave coupling material portion of the intermediate strip layer 7.

Figure 3:
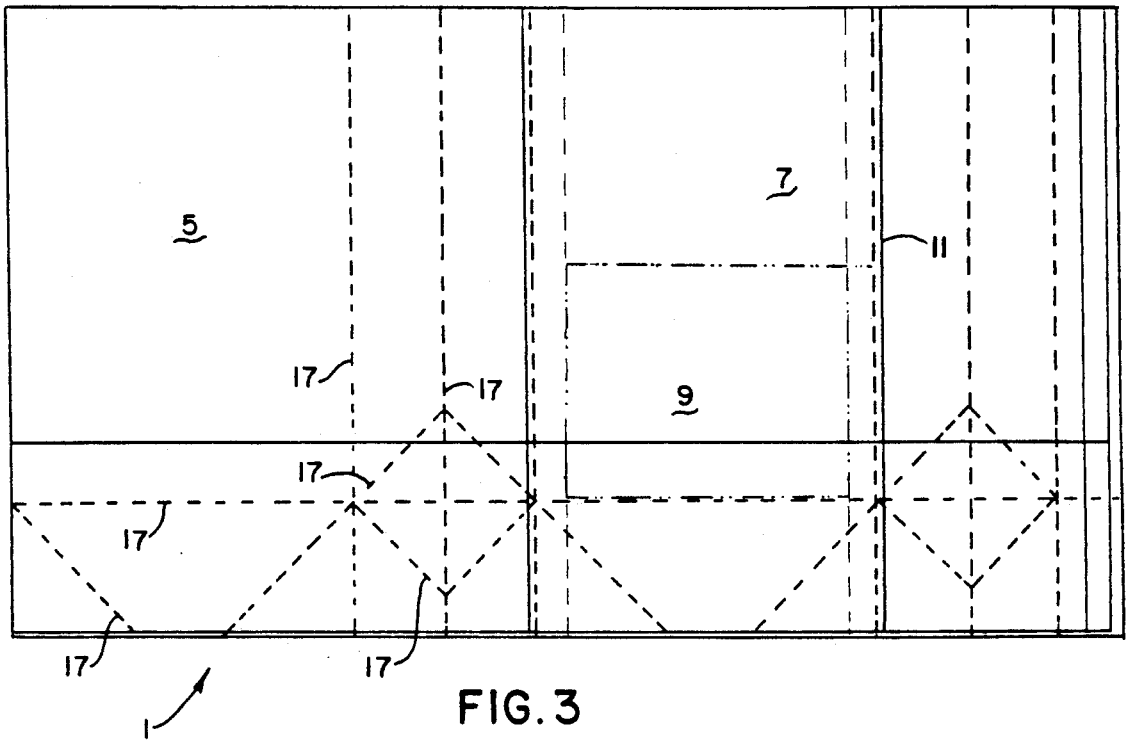
FIG. 3 is a top plan view of a pre-formed blank of material showing fold lines as dotted lines along which the blank is folded to form the pre-formed bag illustrated in FIG. 4 of the drawings.
Figure 4:
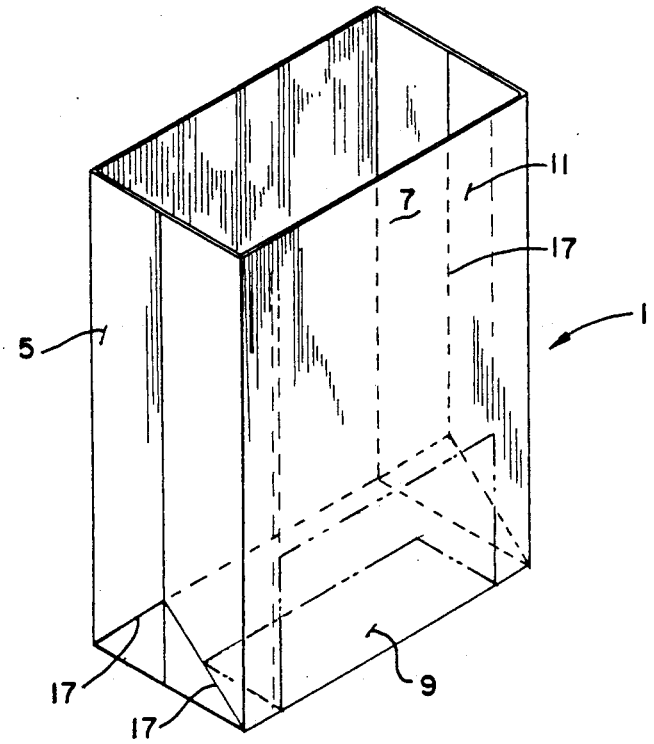
FIG. 4 is an isometric view of a pre-formed bag formed from the die cut and folded blank of FIG. 3, which is typically formed from with the multi-layered packaging material of the present invention.

It will be noted that the intermediate strip layer 7 has a substantially smaller width than the flexible bottom layer 5 so as to be contained within one of the bag sides and/or bottom, as shown in FIGS. 3–4 of the drawings. As illustrated in these figures, the microwave coupling portion 9 of the intermediate strip layer 7 is positioned so as to extend partially within one of the sides and along the bottom of the laminated package or blank 1 in FIG. 3 of the drawings, and also when folded in the pre-formed bag as shown in FIG. 4 of the drawings.

As shown throughout the various figures of the drawings, the intermediate strip layer 7, in addition to having a narrow width of only about 5"-6", is offset to one side of the bottom flexible layer 5, in order that the microwave coupling portion 9 may be suitably positioned in one of the bag sides and/or bottom of the laminated package or blank 1, as shown best in FIGS. 3-4 of the drawings.

While most prior art multi-layer packaging materials used for microwave popcorn purposes include an upper or inner ply of the same width as the bottom flexible layer 5, the present invention is a novel departure from the prior art in that the upper masking layer 11 has a dimensional size only slightly larger than the intermediate strip layer 7, including the microwave coupling portion 9, and is provided with overlapping edges 13, 13 on opposite sides thereof which are adhesively bonded to the lower flexible layer 5 in order to produce the multi-layered packaging material of the present invention. This upper masking layer 11 is also formed from a flourocarbon and grease proof treated sheet such as Rhinelander Grade 2382507 25# GP FCT. The overlapping edges 13, 13 of the upper masking layer 11 extend a short distance beyond the intermediate strip layer 7, including microwave coupling portion 9, in order to permit the overlapping edges 13,13 to be adhesively bonded to the lower flexible layer 5. Preferably, the upper masking layer 11 is usually only about 1/16"-⅛" wider than the intermediate strip layer 7, including microwave coupling portion 9.

In securing the aforementioned layers to one another, an FDA approved, water based, low odor adhesive such as polyvinyl acetate manufactured by Ajax Adhesive Industries, Inc. of Chicago, Ill. and identified as MA-479-3 is preferably utilized. As shown in the enlarged fragmentary sectional view of FIG. 2B, the adhesive just described is generally indicated at 15 between the flexible bottom layer 5, the intermediate strip layer 7 including microwave coupling portion 9, and the upper masking layer 11.

According to the construction and features incorporated in the laminated package or blank 1, whereas "trapped-in" moisture from the water based adhesive, that was trapped between the layers, created "wetness" and odor in prior art designs, with the construction of the present invention, this has been substantially, if not totally eliminated.

As will be appreciated, since the full width inner ply of prior art constructions has been eliminated, the upper masking layer 11, has a dimensional size only slightly larger than the intermediate strip layer 7, including microwave coupling portion 9, and is also of substantially smaller width than the lower flexible layer 5, there is no longer a "trapped-in" moisture problem because the adhesive 15 has a "raw" edge for moisture evaporation, along the overlapping edges 13, 13 of the upper masking layer 11.

While eliminating "wetness" and adhesive odor, the above described structure contains all of the other functions of multi-layered packaging materials previously developed. In addition, substantial cost reduction has been achieved by eliminating substantial amounts of adhesive, approximately 70%, as well as a full width upper or inner ply, as used in prior art constructions.

In FIG. 3 of the drawings, the laminated package or blank 1 is shown after it has been separated from the inner connected strip, and just prior to being folded into bag form and sealed to itself to form the bag structure of FIG. 4 having sides and a bottom. The dotted lines 17 represent fold lines or creases forming the gussets in the laminated package or blank 1, enabling the same to be folded into bag form as shown in FIG. 4 of the drawings.

As shown in FIG. 1 of the drawings, the supply rolls 19, 21 and 23 illustrate the supply of continuous strips or layers 5, 7 and 11 in forming the multi-layered packaging material of the present invention. The adhesive 15 is applied to the continuous strips 5, 7 and 11 shortly after they issue from the supply rolls 19, 21 and 23, such as by spraying, brushing or any other suitable means. Pressure or laminating rolls (not shown) may also be used to securely bond the layers 5, 7 and 11 relative to one another as will be understood.

From the foregoing it will be appreciated that the multi-layered packaging material and method of the present invention eliminates "wetness" and adhesive odor, while providing substantial cost reduction through reduction of materials used and improve production speeds. At the same, all of the other functions of the packaging material, such as employing non-wicking grease proof sheets and microwave coupling material, are retained with all of the new and improved features and procedural steps in the multi-layered packaging material method of the present invention.

In view of the above it will be seen that the several objects of the invention are achieved and other advantageous results are obtained.

As various changes could be made in the above constructions and methods without departing from the scope of the invention, it is intended that all matter contained in the above description or shown in the accompanying drawings shall be interpreted as illustrative and not in a limiting sense.

I claim:

1. A multi-layered packaging material for use in wrapping, packaging and shipping articles comprising:

a flexible layer of food grade paper material having a predetermined width which is capable of being folded into bag form and sealed to itself to form a bag structure having sides and a bottom;

a strip layer of microwave coupling material which becomes hot in a microwave oven when exposed to microwave energy, said strip layer having a substantially smaller width than said flexible layer so as to be contained within at least one of said bag sides and bottom;

a masking layer of food grade paper material overlaying said strip layer having a dimensional size only slightly larger than said strip layer and providing overlapping edges which are adhesively bonded through the application of adhesive to said flexible layer to provide said multi-layered packaging material;

said flexible layer being adhesively bonded through the application of adhesive to said strip layer and said masking layer being adhesively bonded to said strip layer with the overlapping edges of said masking layer being adhesively bonded to said flexible layer;

said masking layer comprising a continuous strip of food grade paper material extending the full length of said flexible layer;

said strip layer of microwave coupling material comprising a series of spaced patches of metallized film contained within at least one of said bag sides and bottom said strip layer comprising said series of spaced patches of metallized film formed on said strip and strategically positioned by the masking layer laminated upon the flexible layer of material;

both said flexible layer and masking layer being formed of a food grade material comprising grease proof paper sheets; and, said flexible layer being adhesively bonded by polyvinyl acetate to said strip layer, and said masking layer being adhesively bonded by polyvinyl acetate to said strip layer, with the overlapping edges of said masking layer being adhesively bonded by polyvinyl acetate to said flexible layer.

2. The multi-layered packaging material as defined in claim 1 wherein the width of said flexible layer is about 19–20", the width of said strip layer of microwave coupling material being about 5–6", and the masking layer being only about 1/16"–⅛", wider than said strip layer of microwave coupling material.

* * * * *